US006539292B1

(12) United States Patent
Ames, Jr.

(10) Patent No.: US 6,539,292 B1
(45) Date of Patent: Mar. 25, 2003

(54) USING LOCATION-INFLUENCED BEHAVIOR TO CONTROL MODEL RAILROADS

(76) Inventor: Stanley R. Ames, Jr., 8 Higate Rd., Chelmsford, MA (US) 01824

( * ) Notice: Subject to any disclaimer, the term of this patent is extended or adjusted under 35 U.S.C. 154(b) by 0 days.

(21) Appl. No.: 09/877,389

(22) Filed: Jun. 9, 2001

(51) Int. Cl.[7] ..... G06F 7/00

(52) U.S. Cl. ..... 701/19; 701/20; 246/62; 105/1.4; 105/1.5

(58) Field of Search ..... 701/1, 19, 20, 701/29, 34, 65; 702/183; 340/901, 906; 246/62, 297; 105/1.4, 1.5, 26.05, 29.2

(56) References Cited

U.S. PATENT DOCUMENTS

| | | | | | |
|---|---|---|---|---|---|
| 4,926,158 | A | * | 5/1990 | Zeigler | 340/310.02 |
| 5,867,404 | A | * | 2/1999 | Bryan | 342/457 |
| 5,956,664 | A | * | 9/1999 | Bryan | 702/184 |
| 5,987,979 | A | * | 11/1999 | Bryan | 73/146 |
| 6,044,698 | A | * | 4/2000 | Bryan | 73/146 |
| 6,220,552 | B1 | | 4/2001 | Ireland | 246/122 |
| 2001/0020430 | A1 | | 9/2001 | Lenz | 105/1.5 |

FOREIGN PATENT DOCUMENTS

DE 100 11 978 3/2000

OTHER PUBLICATIONS

"Renewed Proposal for Signal Controlled Speed Influence and Train Number Identification for NMRA–DCC protocol", ZIMO Elektronik, Oct. 13, 1996.

"ZIMO Prposal to NMRA for Signal Controllrd Speed Influence and LOCO Number Identification", ZIMO Elektronik, Mar. 3, 1998.

* cited by examiner

*Primary Examiner*—Gertrude Arthur
(74) *Attorney, Agent, or Firm*—Quarles & Brady LLP

(57) ABSTRACT

New methods and techniques are presented for utilizing digital information transmitted by a moving device (such as a model locomotive on a model railroad) to allow the moving device to itself influence the way it is controlled and allowing a moving device (such as model locomotive on a model railroad) to itself send specific instructions or cause others to send specific instructions to other devices on the model railroad for the purpose of controlling or influencing their behavior. These methods and techniques can be employed in the control, automation and operation of scale model railroad layouts to permit significant increases in the level of automation that can be utilized on a model railroad and with this increase the illusion of operating a real locomotive.

29 Claims, 11 Drawing Sheets

USING LOCATION-INFLUENCED BEHAVIOR TO CONTROL MODEL RAILROADS

CROSS REFERENCE TO RELATED APPLICATIONS

Not Applicable

BACKGROUND OF INVENTION

In 1991 the National Model Railroad Association issued a request for proposals for a standard for command control. In early 1992 the NMRA DCC working group held its first meetings. The basic charter of the working group was to specify a standard Digital Command Control at the track level. The intent was to have an open form of model railroad control, to allow for the interchange of equipment manufactured by different companies. Standards for this form of model railroad control were approved by the NMRA membership in 1994. Currently 29 manufacturers have been issued manufacturer IDs and a wealth of compatible DCC product are now available for model railroad use world wide. There are also a number of other forms of digital control of model railroads in use today.

NMRA DCC and other similar forms of model railroad control in use today utilize a form of control referred to as open loop. The command station sends an instruction to a moving device within the locomotive and the modeler uses visual means to determine if the desired operation occurred. The Command Station has no idea if the moving device received the transmission or is even present on the layout. This is a very effective form of control as has been shown in the widespread use of NMRA DCC. However it has its limits.

Currently there is no method for a moving device to initiate the transmission of information to the control system. Without this transfer initiation it is not possible for the control system to base its decisions on what is actually occurring within the locomotive on the layout. The one exception is Service Mode. In service mode the moving device has the ability to transmit back an acknowledgement, by providing a load which the control system can identify. This is used by the control system to display to the user the contents of Configuration Variables that are stored in the moving device. An example of this is the ability to read the address of the decoder within a locomotive while on a special service mode section of track. Other techniques for detecting information are described in Zimo, Digitax and Lenz (discussed below).

Existing forms Location behavior influence. Location-influenced behavior is a technique for automating the desired operation based on the location of the locomotive or train on the layout. Having a train automatically reverse its direction at two end points is perhaps the simplest example of location-influenced behavior. Another primitive form of this technique currently in use is stopping a train in front of a red signal by transmitting a broadcast DCC stop packet to the moving device located within the block preceding the signal.

Automatic reversing units have existed for many years. They consist of a location detector at two end points and the polarity of the track being reversed each time one of the two detectors is activated.

In NMRA DCC the polarity of the rails has no effect for influencing the locomotive direction. To reverse the direction of a DCC locomotive you must transmit a specific instruction telling the locomotive to reverse. This instruction is transmitted by the command station (signal generator) to the specific locomotive.

To construct an automatic locomotive reversing section in DCC one must first detect the locomotive (a primitive form of communication from the locomotive operating on the layout to a device connected to the layout) and then instruct the signal generator to reverse this locomotive. To demonstrate this concept a CAB (device used by the operator to control model trains) was modified so that direction switch is controlled by a relay that is connected to two detectors placed at either end of the reversing track section.

This primitive technique illustrates the basis for all forms of location-influenced behavior. The locomotive on the operational layout sends information to a detector. The detector transmits this information to the command station and based on this information the command stations sends new information to the locomotive to change its operation behavior or its direction of movement.

While this primitive type of DCC location-influenced behavior works, it has its limitations because the detector only gets one bit of information, that being the presence or absence of a current load on the track. If more than one locomotive is on the track section, the reversing can only work for the loco that the handheld has addressed. Without a more advanced form of two way communication it is not possible for the detection device to determine which locomotive is in the track section and therefore which locomotive it should influence behavior for.

In 1996 Zimo GmbH ("NMRA TN-9.2.1 Restricted Speed Instructions dated June 1998") presented a specification for a much more refined approach where the control system could tell the model locomotive to perform a much wider variety of operations at a specific location. This was accomplished by modifying a series of bits to tell the locomotive a specific operation to perform. Zimo calls this technique signal controlled speed influence. This technique allows a device along the layout to send specific speed or function commands which can be executed by any locomotive that passes into the region controlled by the track detector. A second form of the Zimo approach is the ability for the moving device to provide up to a 4 bit acknowledgement for specific commands sent. The approach is effective for trains with single locomotives but becomes much more complex when more than one locomotive is controlling the train. The reason for this is that the detector does not know how many locomotives are in the train and thus must have a small area for detecting the presence of the train and a larger area for influencing the behavior based upon a fixed maximum length of the train. Other disadvantages of this approach are that the locomotive can not initiate an action, all actions must be initiated by the detector and the approach affects all locomotives entering the region.

Detecting the identity (address) of a moving device can be done in one of two methods using the Zimo approach. The Zimo locomotive identification feature is for the command station to send a specific command to the moving device which the moving device will acknowledge. The acknowledgement is detected and by integrating the request with the response the knowledge that that particular moving device is somewhere in the detection zone is determined. The problems are that commands are not refreshed to a specific moving device with sufficient frequency to allow this method to effectively be combined with the behavior influence, it is not possible to determine the identity of an unknown device unless all 10,000 addresses are transmitted (requires over a minute to transmit) and the necessity to increase the preamble bits for a packet as the influenced bits may not always be read as proper bits. This slows down the transmission and is not compatible with other systems on the market that conform to the NMRA DCC Standards and Specifications. A third major problem is that the method Zimo uses to transmit the bits is a 5 amp current pulse which over time may damage the current pickups of the moving device.

Digitrax (ref U.S. Pat. No 6,220,552, issued April 2001 for a specific method for detecting a bit transmitted by the moving device) solved both the pickup damage and the preamble addition problems by transmitting the bits via a series of low current pulses which, while more difficult to detect, allow for use on any conforming NMRA DCC system. Like the Zimo approach, this detector is able to detect the receipt of specific commands being received by a moving device as specified in NMRA RP-9.2.1 (dated August 1994). Since the commands acknowledged are address specific, the detector is able to determine the specific moving device that is in its control area. While useful for identifying locomotive location it suffers many of the same limitations that the Zimo approach does, in that the locomotive can only acknowledge a specific command sent to it and the locomotive can not initiate communication on its own. If no commands are sent to the locomotive, no acknowledgement will ever be received and an acknowledgement plus a few bits is insufficient bandwidth for a device to initiate control communication with another device. The Digitrax approach, like the Zimo approach, both suffer from the command refresh rate. The detector can not detect the presence of the moving device if a packet has not been transmitted to that moving device' address. Digitrax solves this by adding a button on the user control Cab to allow the user to initiate the location inquire packet. The invention covered by this specification solves this problem by having the moving device constantly transmits it address and train type information. Both the Zimo and Digitrax approach also have limited transmission ability and are not able to have the moving device influence it's behavior other than acknowledging the receipt of a specific command as described in the NMRS DCC specifications. The invention covered by this specification solves these problems by utilizing the entire transmission packet for transmission back and be defining self clocking zones for the different types of information being transmitted.

Lenz (German Patent Application 100 11 978.6, Filed March 2000) introduced a frequency based bit transmission technique that could be transmitted on the zero bits within the packet. This allowed more data to be transferred but did not address the bi-directional communication necessary for location-influenced behavior.

Combining the various approaches will also not work. This is because the broadcast and packets acknowledgements currently occur at the same point in time and the transmissions conflict with each other.

All these existing forms of communication are based on the premise that you can only influence the behavior of a model locomotive (example of a moving device) in a specific location and then only get back an acknowledgement that the action was successful. None of the proceeding technologies allowed the locomotive to initiate activity.

The 2001 Lenz GmbH refined their 2000 patent application to allow the transmission to occur on all bits within the packet. The refinement to the patent application that was needed was to detect the harmonics of the signal rather than the signal itself. This approach allowed for the transmission and receipt of additional bits which is a precursor for enabling location-influenced behavior. The demonstration that Lenz used to demonstrate their improved bit detection technique was a detection device that could detect broadcast address information transmitted by all moving devices on the model railroad in the preamble of a packet. This technique removed the address dependent limitations that were present in past designs. The disadvantage of the Lenz approach is that the detector is not connected to the control system and does not integrate the packet transmission with the broadcast information received. In Addition since the approach is broadcast only, insufficient information can be transmitted to enable complete closed loop control. All the techniques (including the Lenz 2001 approach) suffer from being able to distinguish between a single transmitter and multiple transmitters transmitting at the same time. Thus the technique is not usable on a real model railroad with numerous moving devices all of which need to influence their behavior. The invention covered by this specification solves these problems by using a multi bit encoding scheme which makes determination of multiple transmitters easy to detect and by identifying a safe zone where it is possible for only a single transmitter to transmit.

SUMMARY OF INVENTION

This invention describes methods and techniques for a moving device on a model railroad to close the communication control loop with the control system by allowing the moving device to engage in bi-directional peer-to -peer communication with other devices on the layout for the purpose of allowing a moving device to control its behavior and the behavior of other devices on the model railroad.

Bi-directional (two way) communications is an attempt to close the loop between moving device and command station by allowing the moving device to transmit information back to the command station. DCC introduced a major revolution to the way modelers controlled their layouts. Bi-directional communications is the technical basis for the next evolution in advanced model railroad control.

Location-influenced behavior is a technique to integrate both broadcast and address specific bi-directional communication to allow a moving device on a model railroad to influence the behavior of other devices on the model railroad. By combining both broadcast and address specific information a moving device on a model railroad can initiate broadcast transmission which will initiate other control events and the control system can utilize this broadcast information to ask the moving device for additional more detailed information (thus reducing the bandwidth for the needed broadcast information) from which the entire control decisions can be made.

These methods are made possible by using the transmitted packet as the timing clock for the transmission, by dividing the transmitted packet up into different zones for the purpose of transmitting different types of information, by using a multi bit encoding scheme that makes it easy to detect when multiple transmitters are transmitting and by utilizing safe transmission zones for receipt of broadcast information.

DETAILED DESCRIPTION

Location-influenced behavior requires multiple forms of bi-directional communication to occur. The first is identifying the address of the device which desires its behavior to be influenced. The second is interrogating the device to receive additional information and the third is to get confirmation that the new data to control the behavior has been received.

This invention solves the problems of the previous designs by providing a framework that allows for both broadcast and address directed communication to co-exist in harmony and by providing methods for determining both valid and invalid broadcast communication. Further, the invention combines the three types of communication (broadcast, address directed, and command acknowledgement) in such a way that all three can be used to solve the inherent problems of location-influenced behavior.

Each of these bi-directional forms of communication require the existence of bit transmission both to the moving device and from the moving device. This invention does not propose or rely on a specific bit transmission in either direction but rather relies on a reliable bit transmission as a prerequisite of the invention.

While this invention does not depend on a specific bit transmission, the first instantiation and the examples provided in this submission rely on the existence of a digital command stream for transmitting the information to a moving device similar in concept to the National Model Railroad Association's Digital Command Control packet formats as specified in S-9.1, S-9.2 and RP-9.2.1 as found on the NMRA;s WWW site at www.nmra.org. This invention also depends on the existence of a suitable method for a moving device on a model railroad to transmit bits back to an external detector. Examples of suitable bit transmission techniques are covered in the Lenz and Digitrax patent submissions referenced to previously.

This invention solves the problem of identifying the address of a moving device by using a broadcast approach, where all moving devices continuously transmit their address. The detector uses this address information to have specific commands sent to that specific address for the purpose of collecting additional information. Using this two step approach solves the inherent problems present in previous attempts.

Figure 1:
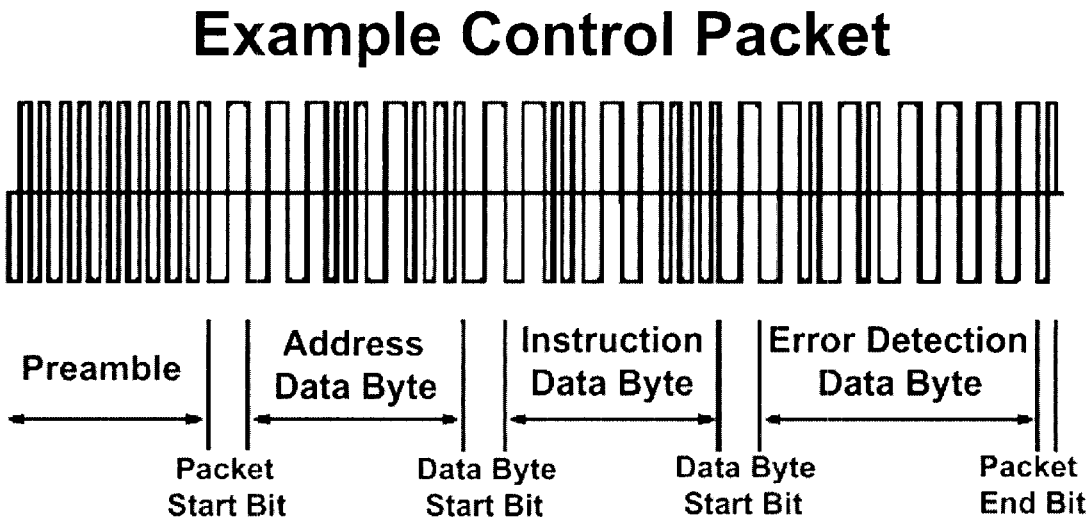
FIG. 1 is an illustration of the NMRA DCC packet structure.
Figure 2:
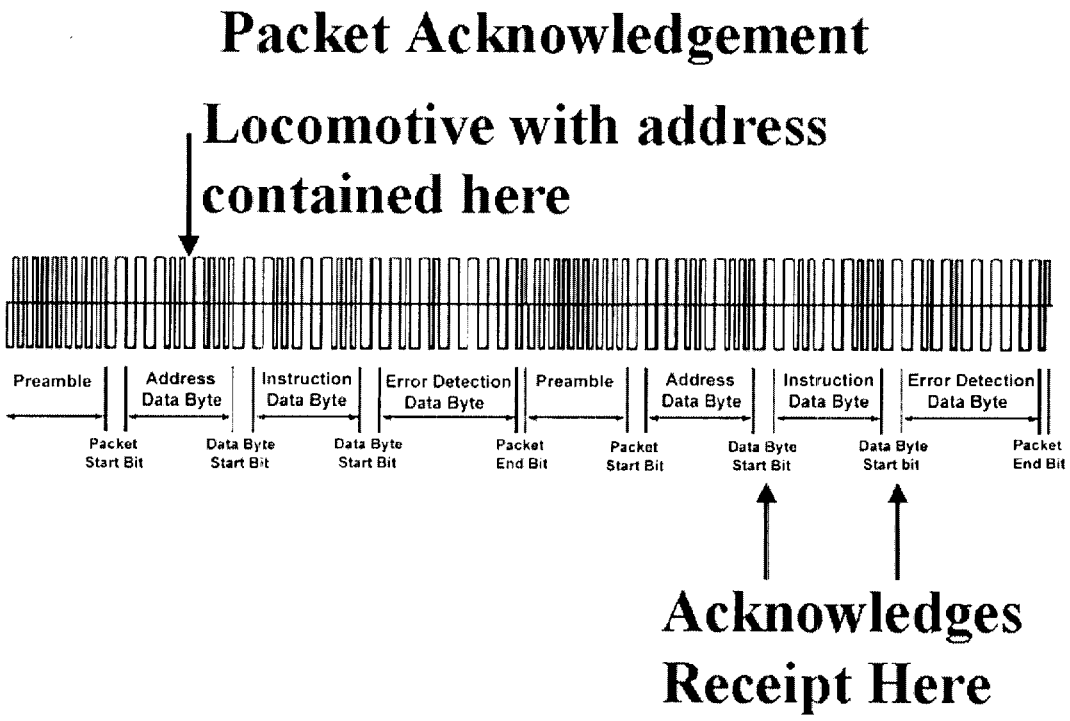
FIG. 2 is an illustration of how the packet structure can be used to perform packet acknowledgement.
Figure 4:
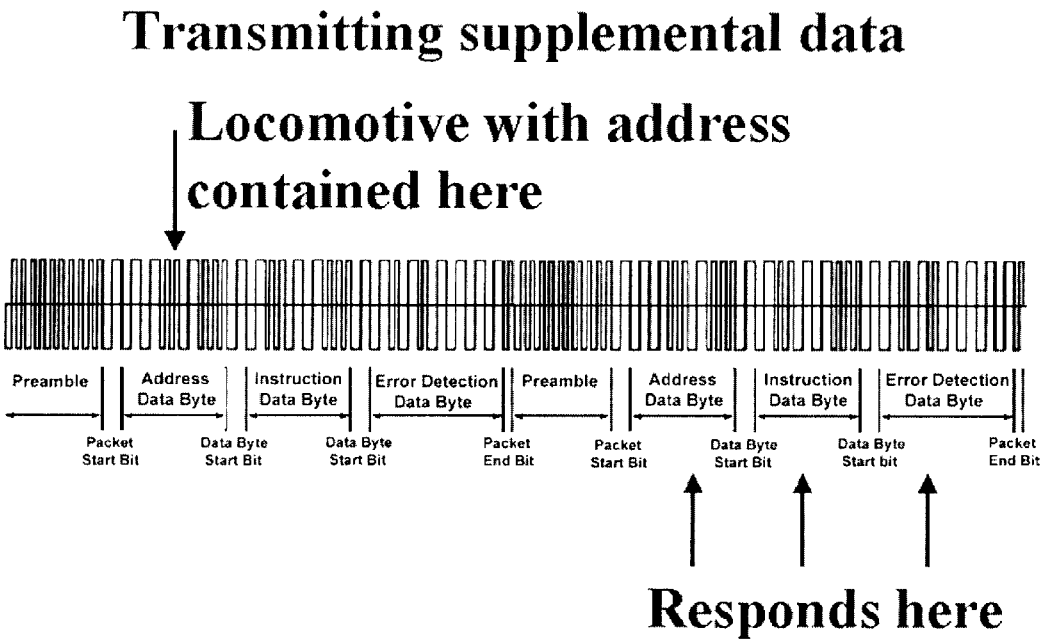
FIG. 4 is an illustration of how the packet structure can be used to transmit three bytes of supplemental data.

The first problem that was solved by this invention was to factor the packet into areas where the various forms of transmission could safely occur. The first step is to factor the packet format into three distinct areas. The NMRA DCC packet (see FIG. 1) was used for this purpose but the technique is applicable to most all other digital control systems for model railroads. FIG. 1 provides the generic bit pattern and packet format for all NMRA DCC packets. FIGS. 2, through 4 show how this packet format can be utilized for providing zones to allow for all three forms of communications. A key concept of this invention is the use of self synchronization of the feedback information tied to the timing of the packets being transmitted.

The first type of bi-directional communication is providing for a moving device to positively acknowledge a command receipt. A negative acknowledgement is also needed to be able to answer specific questions. Within the DCC packet there are two places that each and every sender, detector and moving device always knows when they will occur. These are the data byte start bit for the 2nd and third bytes of a packet. The inter byte start bits are used as their timing location is precisely defined. Command acknowledgement (FIG. 2) is transmitted during these first two interbyte bits of the packet that follows trigger packet which is addressed to a specific moving device. Two bits are used to transmit to avoid the error condition of multiple transmitters and to provide both a positive and a negative acknowledgement.

The second type of bi-directional communication needed for Location-influenced behavior to function is knowing the identity of the moving device that enters the detection zone as soon as possible. Sending packets to all addresses does not work because there is a non deterministic delay in the receipt of packets and thus the receipt of the acknowledgement. Thus there is a indeterminate delay from the time the moving device entered the detection zone and the time the detection occurs. To solve this problem the design for Location-influenced behavior has each and every moving device broadcast its identity and other important characteristics. This allows the moving device to identify itself and provide maximum time for the receiver to generate a command to influence its behavior. The specific location that the moving device is detected is also determined so precise operation is possible.

Figure 3:
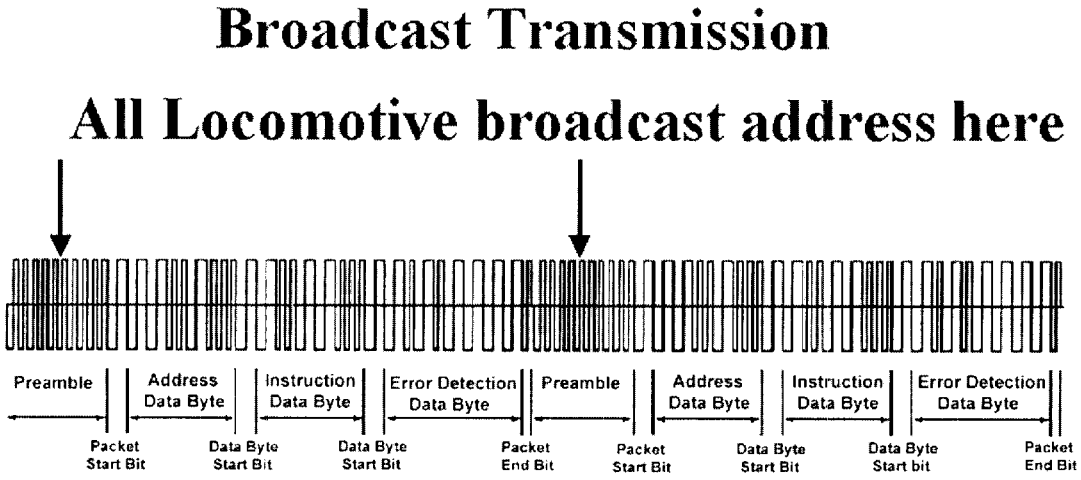
FIG. 3 is an illustration of how the packet structure can be used to perform packet acknowledgement. Broadcast information is used to transmit the moving device's address and other supplemental information.

Data communications for model railroads require a mechanism to synchronize the transmission and the receipt. There is a unique area where the moving device can determine that a new packet is being transmitted. In the DCC packet this is called the preamble. While a moving device inside the moving device can not determine the end of the preamble, it can determine when the previous packet ends and thus the beginning of the sequence of bits that culminates with a valid preamble. Since there is always a minimum time between the packet end bit and the packet start bit for the following packet, this time period provides an excellent window for broadcast transmission. There is a minimum of 14 bits in the preamble including the packet end bit. This leaves 13 bits upon which to transmit information. To effectively utilize this space one needs to both transmit the identity of the sender as well as instructions and necessary data to influence behavior. Because the volume of information to be transmitted exceeds the time allotted, alternate transmissions are performed, one with first half of the data the other with the second half of the data. By alternating packet transfers and combining this with the ability to send multiple types of information the moving device can broadcast both its identity and a limited amount of information from which the detector can determine what the moving device desires. FIG. 3 illustrates when broadcast information is transmitted.

The third type of bi-directional data needed for Location-influenced behavior is data transmission, used to transmit specific information from the moving device to an external device such as a handheld or detector. To accomplish this, this invention uses the first three bytes of the packet that immediately follows the trigger packet. Three bytes were chosen because three bytes are the minimum packet size and the immediate subsequent packet is a well defined point to avoid collisions. Other packet formats will vary but the design of using the subsequent packet is uniform across any implementation. Supplemental data transmission is illustrated in FIG. 4.

Combining all types of communication allows for three separate but distinct forms of communication to exist. 1) a packet acknowledgement during the inter byte bits of the subsequent packet, 2) a broadcast during the preamble, and 3) a three byte data transfer during the subsequent data packet and a packet acknowledgement during the inter byte bits of the subsequent packet.

Using the proposed framework for bi-directional communication a detector can detect the actual address of the moving device within the detection zone and from this request specific commands be sent to that particular moving device to do such things as restrict the speed of the train in front of a yellow signal or through an interlocking, stop the train at a station or in front of a red signal, or blow the whistle in front of a grade crossing.

Other uses of Location-influenced behavior include allowing the user to place a moving device on the track and instantly being told of the moving device' address. Such a technique is also useful in hidden yards for identifying specific trains. This invention also includes a technique for the moving device to tell the system which route to take and for the moving device to also tell the system what type of train it is, for the purpose of influencing the behavior modification (high speed passenger trains have different rules at signals than slow freights.) These techniques are described in subsequent paragraphs.

Figure 5:
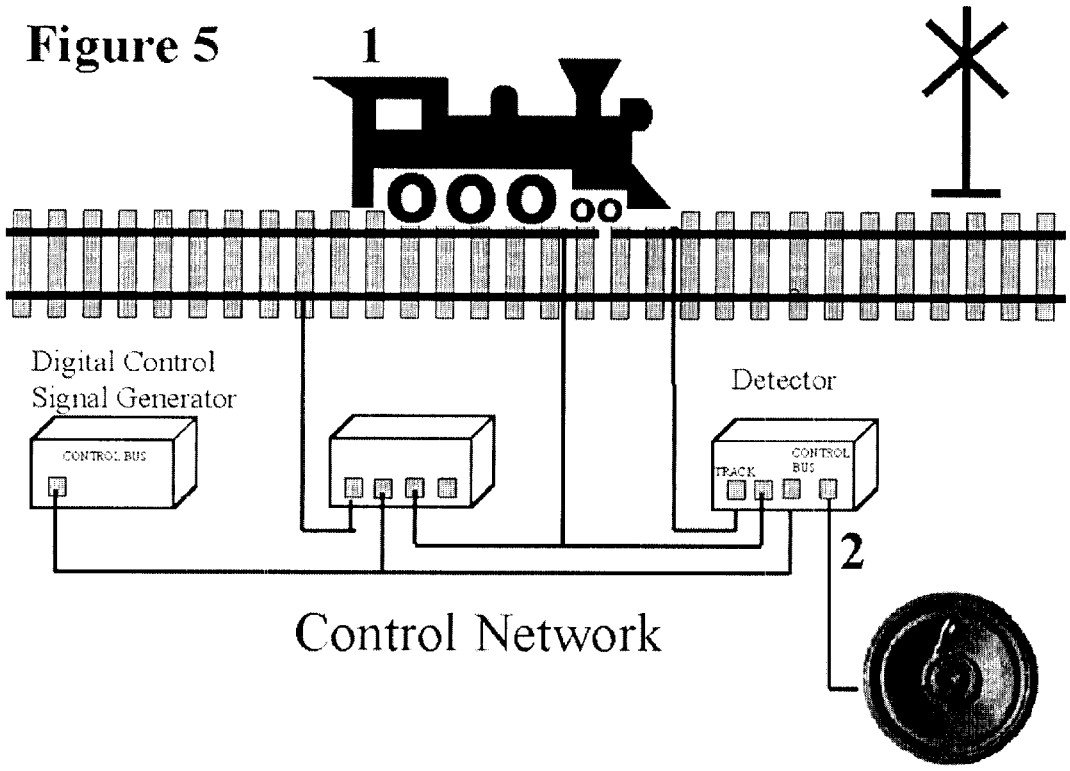
FIG. 5 is an illustration of how location-influenced behavior can be used to allow a moving device to control the type of sound that is played at a specific location on the layout.

In the following paragraphs specific examples are provided to back up the claims made in this application. FIG. 5 provides a method for a moving device to influence the behavior of an external device. In this method the moving device transmits its identity for the purpose of sounding specific sounds as it approaches a grade crossing. The locomotive moving device sends a broadcast command which is read by a detector along side the layout. Based on the train type information received the detector selects the correct sound type and transmits it to an under table sound device. The result is that the moving device has influenced the behavior of the under table sound device

[t1]

[Method for a moving device to influence the operation of a stationary device (FIG. 5)]

1: The moving device broadcasts its address and train type.
2 A detector listening to information being transmitted, detected the arrival of the train in its detection zone. Based on the train type the detector causes the transmission of the desired sound to a speaker located under the layout. For example a steam whistle for a steam train and a diesel whistle for a diesel as the train approaches a grade crossing.

Figure 6:
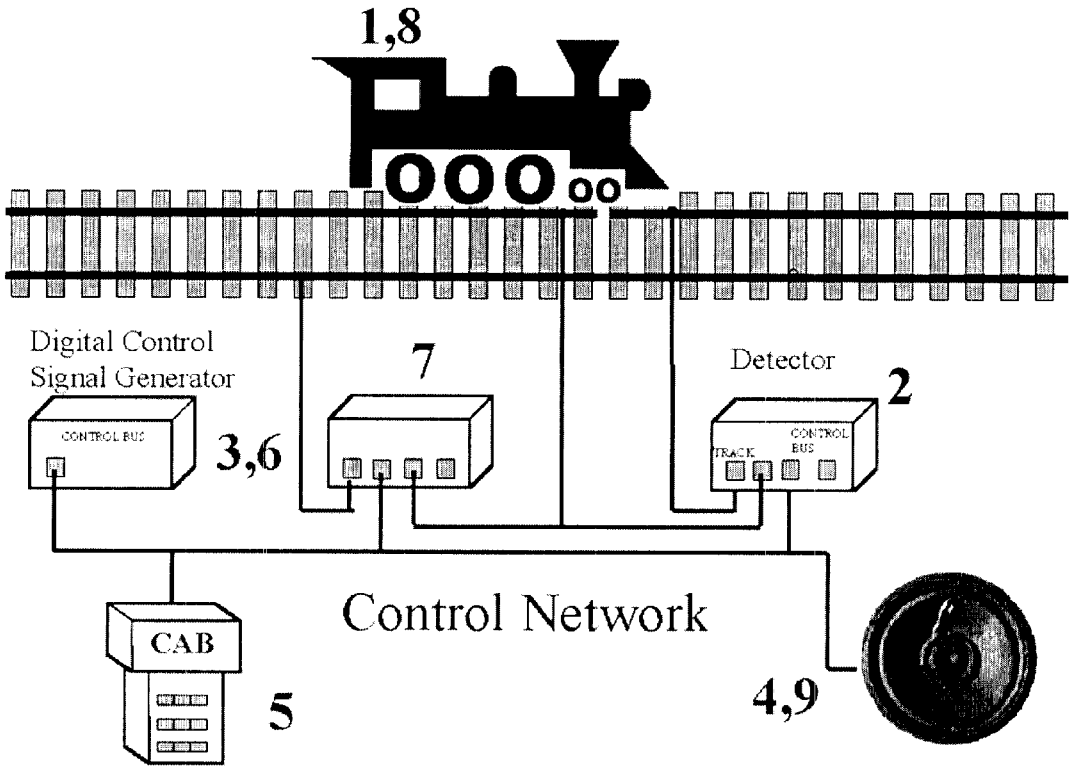
FIG. 6 is an illustration of how location-influenced behavior can be used to control an under table sound system where the sound travels with the location of the moving device.

FIG. 6 illustrates a method for a control system to control an under table sound system based on the location of the moving device on the layout. This allows the sound under the layout to follow the location of the moving device on the layout. As the moving device moves the under table sound device activated changes which provides the illusion that the sound is actually coming from the moving device.

[t2]

[Method for moving device to influence the behavior of an external sound system (FIG. 6)]

1 The moving device broadcasts its address and train type.
2 A detector listening to information being transmitted hears the arrival of the train in its detection zone and transmits the desired information to the signal generator, which tells the specific sound generator to respond to sound commands sent to this moving device' address.
3 Alternately, the signal generator addresses the nearest sound generator and assigns this sound generator to listen to specific instructions for the specific locomotive in its area.
4 The sound generator begins transmitting background sounds unique to the train type being controlled and the speed of the locomotive.
5 A user changes the speed of the locomotive and desires to blow the horn.
6 The signal generator transmits the specific commands to the locomotive address
7 This information is amplified and transmitted to the track
8 The locomotive changes the speed and if applicable performs the desired function
9 The sound generator being assigned to the same address hears the same commands and changes the background sounds to reflect the new speed and the other user initiated sound functions are also activated. As the train moves on the layout, the assignment of the signal generator generating the sound moves with the train providing the illusion that the sound is coming from the moving device on the layout.

Figure 7:
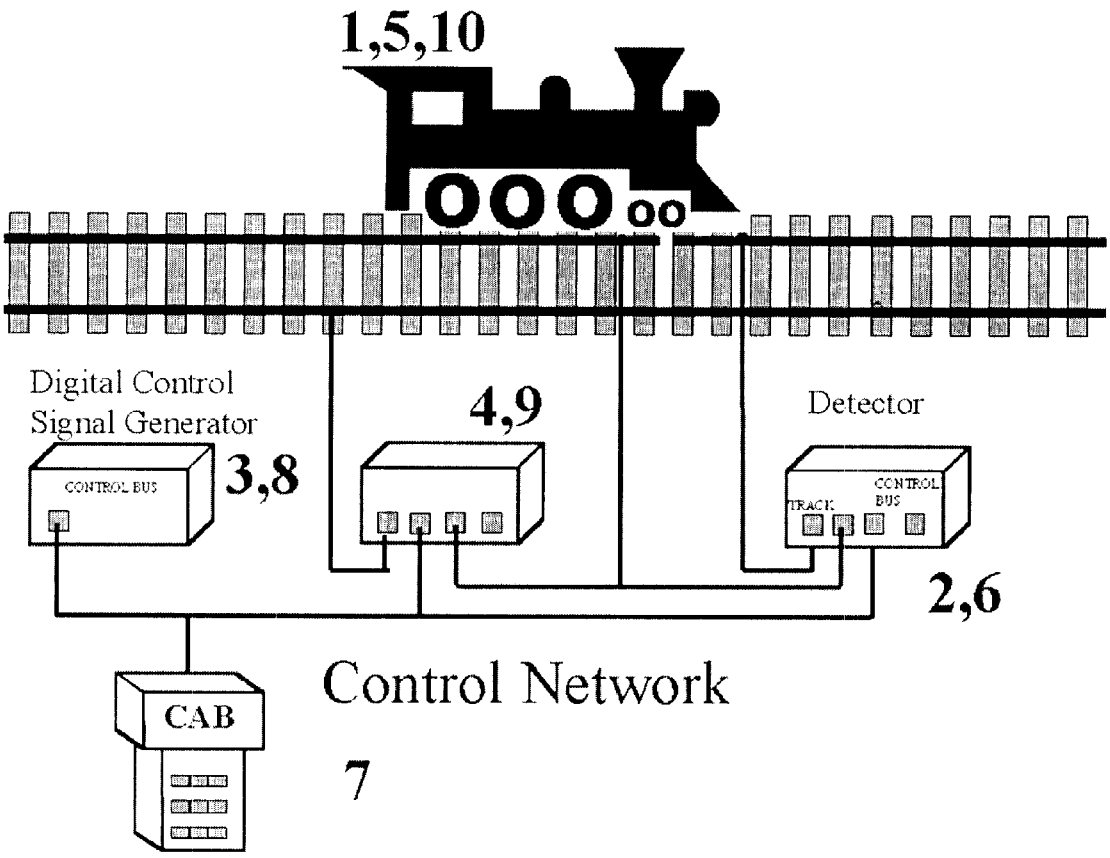
FIG. 7 is an illustration of how location-influenced behavior can be used to allow a moving device to control in real time how the look and feel of the operators interface can be altered to reflect the actual load conditions being encountered by the moving device.

FIG. 7 illustrates how the data transmission method for a moving device on the model railroad can be used by the moving device to influence the way a user controls its behavior. This is provided to allow the model railroad operator to have the illusion of the experience of actually operating a prototype locomotive.

[t3]

[Method for moving device to influence the look and feel of the control system being used by the operator (FIG. 7)]

1 The moving device on the model railroad is constantly transmitting its address and train type information.
2 A detector connected to the track detects the presence of the moving device and notifies the digital control signal generator that this particular moving device has entered its detection zone.
3 The digital control signal generator transmits a refresh speed and direction packet to the moving device.

-continued

4 A power station adds current to the instruction and transmits it to the moving device on the layout.
5 The moving device determines that the instruction is for itself by comparing its address to the address in the instruction and performs the desired operation. In the packet that immediately follows the instruction the moving device transmits the back emf load information that represents the current draw of the motor and in turn the load of the entire train.
6 A detector connected to the track listens both to the transmission of packets to the railroad and to response coming back from the layout. The detector performs the data aggregation to associate the data being received with the address transmitted in the previous packet and transmits the load received to the cab device that is controlling the train
7 The cab now knowing the load of the train being controlled can modify the look and feel of the user interface. For example, a lightly loaded train will respond quickly to a minor variation of power or breaking applied. A fully loaded train has more momentum and responds much slower. Adjustments can also be made by the cab as a result of changes of load received due perhaps to the train climbing a grade. New information for control is transmitted to the digital control signal generator.
8 The digital control signal generator constructs new instructions based on the user input from the cab and transmits this new information to the power station.
9 A power station adds power to the signal and transmits it to the moving device on the layout.
10 The command station can make this information available to a controlling device (handheld) which can vary the braking rate and acceleration rate based on the load derived from the back emf energy. This information can also be made available to an under table sound system for the purpose of varying the volume and chuff rate sounds of the locomotive. This revised information can then be used to subsequent commands to the moving device on the model railroad (locomotive).

Figure 8:
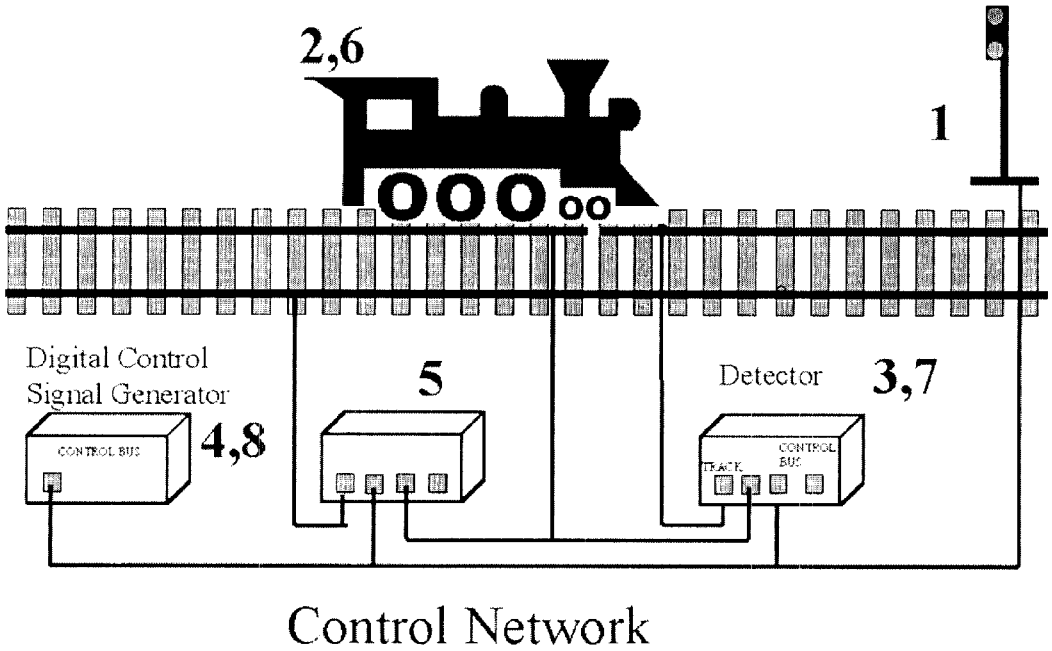
FIG. 8 is an illustration of how location-influenced behavior can be used to allow a stationary device on the model railroad to influence the control of a moving device on the model railroad.

FIG. 8 illustrates how a stationary device on the model railroad is used to control the behavior of a moving device on the layout. This method can be augmented to also allow the moving device to transmit the route it wishes to take. The steps are then augmented by having the digital signal control generator first set and clear the desired route and then clearing the signal and instructing the moving device to proceed.

[t7]

[Method for stationary device on a model railroad to influence the behavior of a moving device on the model railroad (FIG. 8)]

1 A signal located on the model railroad is instructed to turn red.
2 The moving device on the model railroad is constantly transmitting its address and train type information and enters the area being influenced by the signal.
3 A detector connected to the track detects the presence of the moving device and knowing that the signal is red instructs the digital control signal generator to stop the train.
4 The digital control signal generator knowing the speed of the train and the train type transmits a series of slow down instructions followed by a stop instructions to the specific moving device.
5 A power station adds current to the instruction and transmits it to the moving device on the layout.
6 The moving device determines that the instruction is for itself by comparing its address to the address in the instruction slows down and stops the train. In the packet that immediately follows each change of speed and stop packet instruction the moving device transmits a positive acknowledgement.
7 A detector connected to the track listens both to the transmission of packets to the railroad and to response coming back from the layout. The detector performs the data aggregation of the acknowledgement with the address transmitted in the previous packet and transmits the acknowledgement back to the digital control signal generator.

-continued

8 Once the train is stopped, the digital control signal generator having received a positive acknowledgement can stop sending refresh packets to the moving device until the signal turns green and the moving device can proceed.

Figure 9:
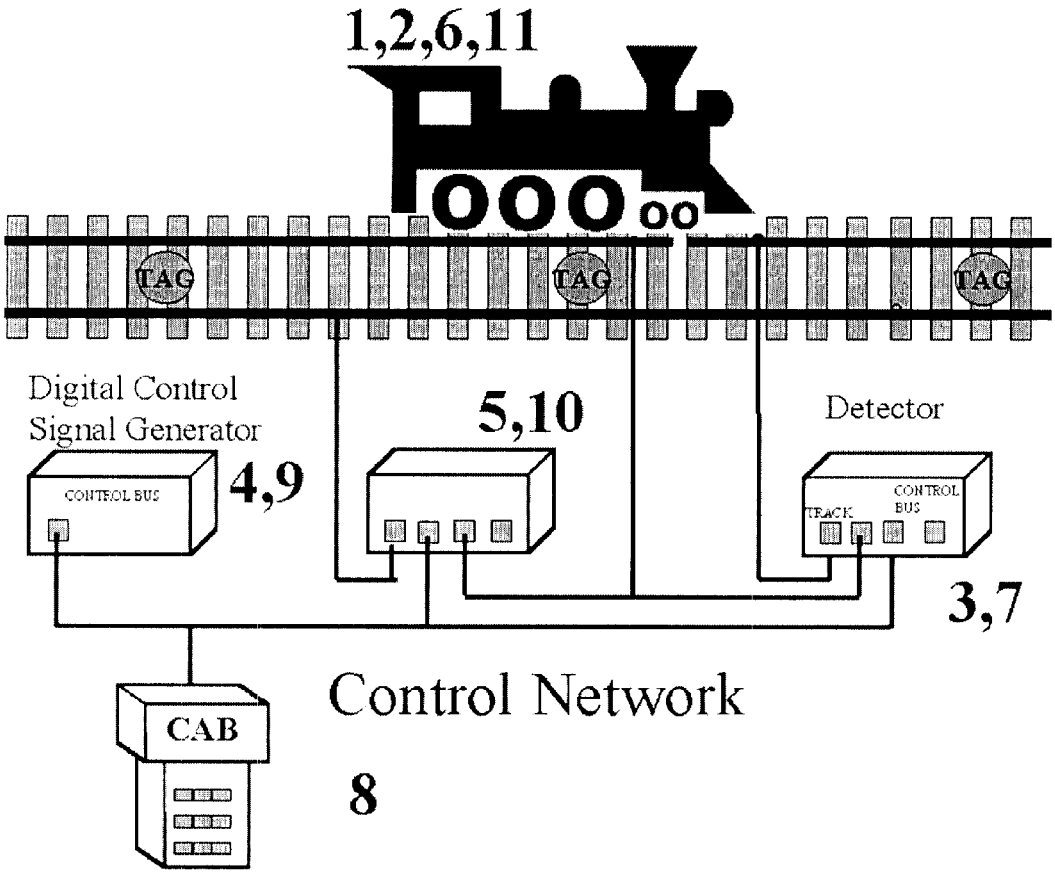
FIG. 9 is an illustration of how location-influenced behavior can be used to allow the moving device to display on the operators display the actual location of the moving device on the model railroad.

FIG. 9 illustrates a combined approach for a moving device on a model rail to influence both its behavior and the behavior of other external devices. This method can also be uses to precisely map out the model railroad by placing data tag transponders around the entire layout such as in every track section.

[t11]

[Method for moving device to provide precise location information to the control system by influenceing the behavior of an external device (FIG. 9)]

1 A moving device on the railroad has a detector that can read data tag transponders located along the layout
2 The moving device on the model railroad is constantly transmitting its address and train type information and an indication that it has data to transmit.
3 A detector connected to the track detects the presence of the moving device and notifies the digital control signal generator.
4 The digital control signal generator transmits a data inquiry packet to the moving device.
5 A power station adds current to the instruction and transmits it to the moving device on the layout.
6 The moving device determines that the instruction is for itself by comparing its address to the address in the instruction and performs the desired operation. In the packet that immediately follows the instruction the moving device transmits the identify of the last data tag transponder it passed over.
7 A detector connected to the track listens both to the transmission of packets to the railroad and to response coming back from the layout. The detector performs the data aggregation of the moving device Data Transmission with the address transmitted in the previous packet and transmits the moving device's address and data to the cab controlling the locomotive.
8 The cab can now display the location of the moving device on the layout.
9 The digital control signal generator can calculate when it can expect the moving device to pass the next data tag and ensure that a refresh packet is sent near the time the tag is passed.
10 A power station adds current to the instruction and transmits it to the moving device on the layout.
11 The moving device can transmit a new tag location once it detects the tag and in this way continuously transmit its location to the cab that is controlling it.

Three technical problems remain to be overcome by this invention for this the methods described above to work. The first is to identify save zone for detecting information in a broadcast environment where the detector can be assured that only one transmitter is actually transmitting. The second is distinguishing between multiple transmitters (especially important in receiving broadcast information, . Once these problems are solved, designs for specific packet formats can be designed to fit within these design constraints.

Figure 10:
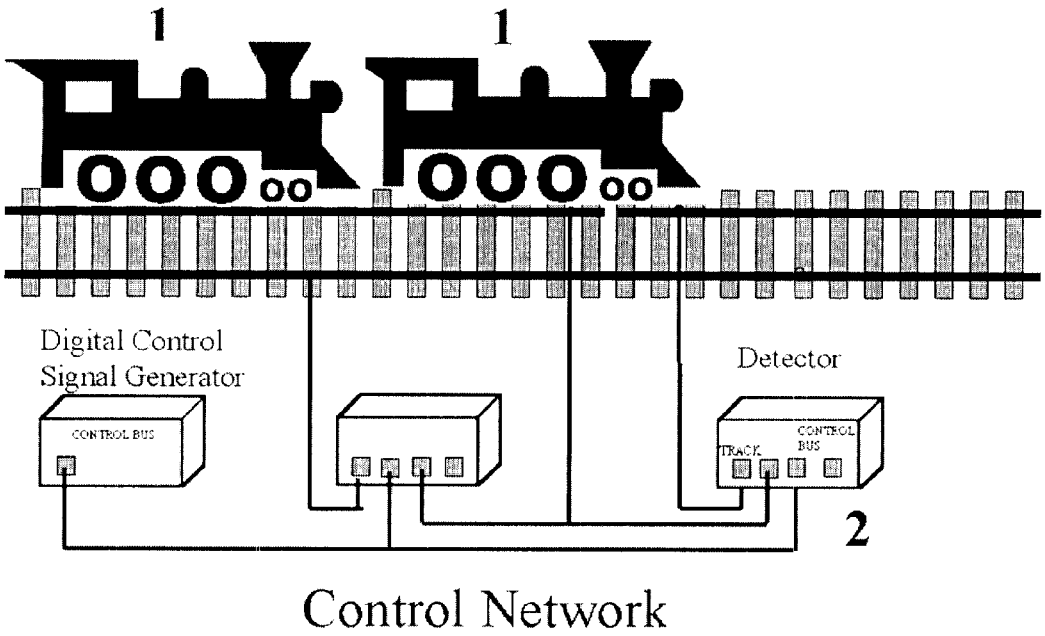
FIG. 10 illustrates the problem of a detector receiving multiple transmissions where a moving device bridges the gap that isolates the detection zone.
Figure 11:
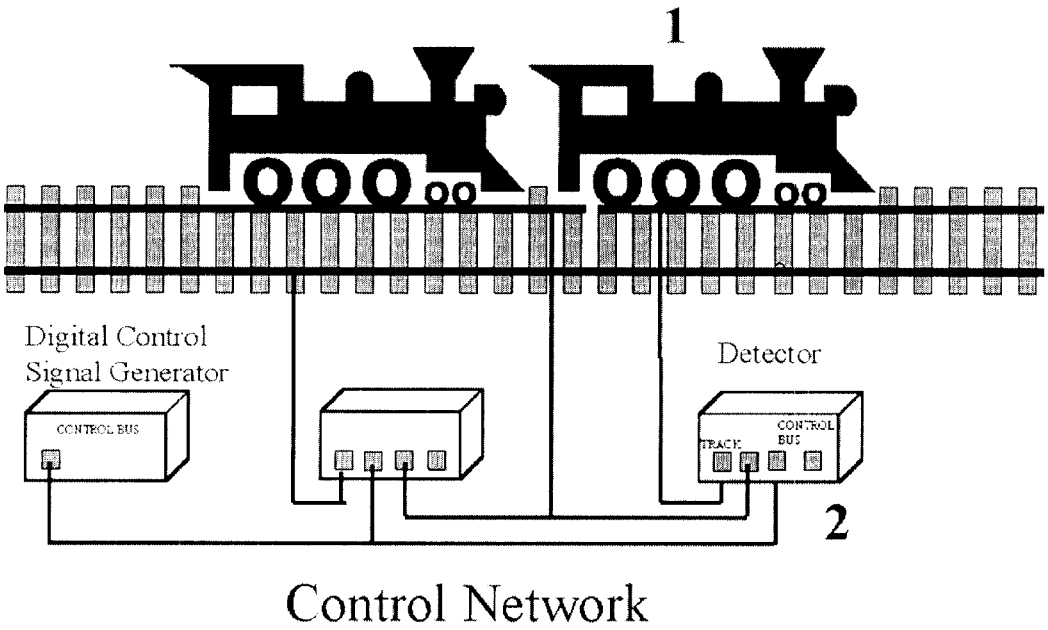
FIG. 11 illustrates the solution to the problem illustrated in FIG. 10 by providing a safe zone that occurs after the rear wheels of the front locomotive have completely entered the detection zone and before the front wheels of the second moving device have entered the detection zone.

If you have only a single locomotive in a block with a detector, detection is simple as you only have a single transmitter. However, when a locomotive bridges the block boundary it may provide the electrical path for the transmission of all the other broadcast data for other locomotives on the layout.. The worst case situation is two moving devices in a consist traveling at a high speed. Using FIG. 10 as an example, if we consider HO for a moment there is slightly more than an inch between the last wheel of the first moving device and the first wheel of the second moving device for the detector to be able to have only a single moving device transmitting in its detection zone. When the first moving device enters the detection zone the moving device itself forms an electrical path allowing the broadcast information of the second moving device to also enter the detection zone. When all the wheels of the first moving device enter the detection zone and before the first wheel of the second moving device enter the detection zone, only a single device is transmitting and the data received is valid. FIG. 11 illustrates this data valid zone. Now consider that the moving devices are traveling at a speed of 100 scale miles an hour. In HO scale for example, a moving device will travel over 20 inches in a second which provides less than 0.05 seconds for the detector to properly detect a transmitter or about 9 DCC packet times. This provides the design constraint, which this invention must satisfy.

Having a valid zone for receiving data is a necessary but not sufficient condition for the invention to function properly. One of the biggest problems using broadcast for bi-directional communication is to distinguish between noise and data. In broadcast transmission all moving devices are simultaneously transmitting information. As in any form of party line communication, when more than one individual talks you have noise and when a single individual talks clearly you have communication. If broadcast is to be used one must determine when two devices are trying to transmit information at the same time.

To solve this problem a data encoding scheme is used that has the same number of on cycles and off cycles for a single transmission. The data encoding scheme uses the concept that a data byte of information is an even number of bits with ½ of the bits always having a value of "1" and ½ of the bits always having a value of "0". For example, a 2 bit byte can have the following valid values "0,1" and 1,0".

For example if you have 4 cycles for communication each communication has exactly two on cycles and two off cycles during 4 cycle times or three on and 3 off cycles during 6 cycle times. Using such a scheme allows the detector to quickly distinguish between noise or bad data and a valid transmission. If two moving devices are transmitting, the receiver will see

[t12]

[Examples of valid and invalid 4 bit cycles]

| Valid | Valid | Invalid | Invalid |
|---|---|---|---|
| 0011 | 1001 | 0001 | 1011 |

Because the packet format used for NMRA DCC has 13 usable bits for transmitting broadcast information during the packet preamble, two 6 bit bytes are used. The possible values of a 6 bit byte with 3 bits always having a value of "1" and 3 bits always having a value of "0" along with an illustrative assignment into a traditional 4 bit binary data byte follow.

[t6]

[Example showing 6 transmitted bits translation to 4 binary bits]

| Transmitted bits | Meaning of bits |
|---|---|
| 111000 | 1111 |
| 110100 | 1110 |
| 110010 | 1101 |

-continued

| Transmitted bits | Meaning of bits |
|---|---|
| 110001 | 1100 |
| 101100 | 1011 |
| 101010 | 1010 |
| 101001 | 1001 |
| 100110 | 1000 |
| 100101 | 0111 |
| 100011 | 0110 |
| 011100 | 0101 |
| 011010 | 0100 |
| 011001 | 0011 |
| 010110 | 0010 |
| 010101 | 0001 |
| 010011 | 0000 |
| 001110 | special 4 |
| 001101 | special 3 |
| 001011 | special 2 |
| 000111 | special 1 |

Using this scheme the detector can always distinguish between valid and invalid transmissions. If a 6 bit data byte is received with either 4 or more "1" bits or 4 or more "0" bits, the detector can ignore the transmission as being invalid.

To satisfy the time constraints imposed with a moving device moving at maximum speed, and still ensuring that more than two complete transmissions can always be received, the following is provided as an illustration on how two to three packets can be used to transmit the moving device's complete address along with four data flags. Additional preambles are used to transmit additional information such as train type and route information.

All moving devices are configured to broadcast a sequence of 13 bit datagrams beginning with the first bit following the packet end bit of a packet. If a packet contains the moving device's own address or is a broadcast address, the moving device may skip the broadcast transmission for the next packet. A single datagram can be sent in a single preamble. Multiple datagrams are sometimes necessary to transmit a complete message. A datagram has the following format. 0 CDDD DDDD The first bit transmitted is a zero (transmission on) which indicates that this preamble contains a datagram.

The CDDD and DDDD nibbles are encoded and transmitted in 6 preamble bits each providing 13 bits needed for transmission (2*6+1). The encoding scheme calls for three 0 bits and three 1 bits to always be transmitted for each nibble. If you receive 4 then you have an error caused by multiple locomotives transmitting. This allows 7 databits to be sent during each preamble. Some datagrams contain more data than can be contained in a single datagram. In this case C is used to distinguish between the first part and the second part. C=0 1st part of transmission, C=1 second part of transmission A 4 digit (14 bit) address is transmitted as 3 datagrams, (the third datagramis optional)

[t14]

[4 digit address transmission]

| | CDDD | DDDD |
|---|---|---|
| 1st transmission | 0, B13, B12, B11 | B10, B9, B8, B7 |
| 2nd transmission | 1, B6, B5, B4 | B3, B2, B1, B0 |
| 3rd transmission | 0,1,0,1 | F1, F2, F3, F4 |

7 bit address is transmitted as 2 datagrams

[t4]

[2 digit (7 bit) address transmission]

| | CDDD | DDDD |
|---|---|---|
| 1st transmission | 0,1,1,1 = normal; 0,1,1,0 = consist | F1, F2, F3, F4 |
| 2nd transmission | 1, B6, B5, B4 | B3, B2, B1, B0 |

Four flags can be transmitted along with the address. These are F4, F3, F2, and F1. The meaning of the flags is as follows.

[t15]

[Definition of Flag bits]

| Flag | Meaning of flag when set to have a value of "0" |
|---|---|
| F1 | Do not influence behavior for this locomotive address. |
| F2 | I have data to send |
| F3 | I am operating at a consist address |
| F4 | Direction of movement is reverse to normal |

The following additional datagrams may be transmitted along with the moving devices address: Train type 1 or 20 options) and or Route Control. Route control allows the moving device to select one of 20 routes that the moving device should be switched to move on.

[t13]

[Additional datagrams for train type identification and desired route identification]

| Message Type | CDDD | DDDD |
|---|---|---|
| Route Control | Special 2 | 1 of 20 routes |
| Train Type | Special 1 | 1 of 20 train types |

Train Type is used to tell the detector the type of train that is entering the detection zone. This is for the purpose of deciding how to control it and also controlling external devices.

[t5]

[Example Train Type Table]

| Transmitted Bits | Train Type Locomotive | Train Type |
|---|---|---|
| 111000 | Steam | Local Switcher |
| 110100 | Steam | Way Freight |
| 110010 | Steam | Fast Freight |
| 110001 | Steam | Local |
| 101100 | Steam | Express |
| 101010 | Diesel | Local Switcher |
| 101001 | Diesel | Way Freight |
| 100110 | Diesel | Fast Freight |
| 100101 | Diesel | Local |
| 100011 | Diesel | Express |
| 011100 | Electric | Local Switcher |
| 011010 | Electric | Way Freight |
| 011001 | Electric | Fast Freight |
| 010110 | Electric | Local |
| 010101 | Electric | Express |
| 010011 | Reserved | Reserved |
| 001110 | Reserved | Reserved |
| 001101 | Reserved | Reserved |

-continued

| Transmitted Bits | Train Type Locomotive | Train Type |
|---|---|---|
| 001011 | Reserved | Reserved |
| 000111 | High Speed Express | High Speed Express |

Operations Mode Acknowledgement As discussed before, the operations mode acknowledgement transmission is transmitted during the first two data byte start bits that occur immediately following the packet requesting the acknowledgement. These two bits were chosen because these are the two bits within all DCC packets that any device can determine when they should start. A moving device responds using the Operations Mode Acknowledgement method in response to commands as described in NMRA S-9.2, and NMRA RP-9.2.1 as configured by NMRA RP-9.2.2.

[t8]

[Operations Mode Acknowledgement Bit assignment]

| Bits Transmitted | Meaning |
|---|---|
| 1 0 | Positive Acknowledgement |
| 0 1 | Negative acknowledgement |
| 1 1 | No transmission |
| 0 0 | Error caused by multiple transmittors |

Moving Device Data transmission works like a synchronous serial data transmission where the packet sent to the track is the clock for the data transmitted back. The moving device Data Transmission Packet is a three-byte packet consisting of two data transmission bytes and one error detection byte. This packet is transmitted during the first three bytes of the packet that immediately follows the packet that contains the request for the data transmission Packet Start Bit: The packet start bit for the moving device data transmission packet is the packet start of the packet that immediately follows the packet requesting the moving device to transmit. There is no transmission during this period. FIG. 1 can be referenced to cross correlate the following table.

[t9]

[Packet layout for data transmission]

| Packet area | What is transmitted |
|---|---|
| Packet Address Byte: | The moving device transmits the 1st Data Byte of information during the Address Data Byte of the packet. One bit is transmitted in each of the 8 bits of the packet address byte, allowing for the moving device to transmit eight bits of information during this period. The first transmitted bit is defined to be the most significant bit of the data byte. |
| 1st Data Byte Start Bit | This bit occurs between the address byte and the first data byte. There is no moving device Data Transmission during this period. (The moving device may transmit an Operations mode acknowledgement during this period) |
| Packet 1st instruction data byte | The moving device transmits the 2nd Data Byte of information during the packets 1st instruction data byte. One bit is transmitted in each of the 8 bits of the packet address byte, allowing for the moving device to transmit eight bits of information during this period. The first transmitted bit is defined to be the most significant bit of the data byte. |
| 2nd Data Byte Start Bit | This bit occurs between the 1st instruction data byte and the 2nd packet instruction data byte (which can also be the error byte per FIG. 1). There is no |

-continued

| Packet area | What is transmitted |
|---|---|
| | moving device Data Transmission during this period. (The moving device may transmit an Operations mode acknowledgement during this period). |
| 2d packet instruction data byte or error detection data byte. | The moving device transmits the 3rd Data Byte of information during the packets 2nd instruction data byte. One bit is transmitted in each of the 8 bits of the packet address byte, allowing for the moving device to transmit eight bits of information during this period. The first transmitted bit is defined to be the most significant bit of the data byte. |

Detectors receiving a moving device Data Transmission Packet shall ensure that the transmission was valid and ignore the contents of the packet if this comparison is not identical.

Using the combination of command acknowledgement, broadcast transmission, and data byte transmission allows for full bi-directional communication to be established between a moving device and a signal generator (command station) or detector, external to the moving device, which allows for complete location-influenced behavior to occur.

What is claimed is:

1. A method for controlling a model railroad, said model railroad including at least one movable device disposed on tracks for movement along said tracks, at least one control device, and a communication network providing bi-directional bit communication between the at least one movable device and the at least one control device, said method comprising:

transmitting an unsolicited identification data package from the movable device over the communication network, said identification data package including data identifying the movable device.

2. The method of claim 1, including selectively transmitting a command data package from the control device to the movable device in response to said identification data package over said communication network, said command data package including data recognizable by the movable device as a command to control the behavior of the movable device.

3. The method of claim 2, including transmitting an acknowledgement data package from the movable device to the control device over said communication network, said acknowledgement data package including data recognizable by the control device as an acknowledgement of receipt of said command data package.

4. The method of claim 3, in which said command data package includes a command to provide information to the control device, and said acknowledgement data package includes the information requested by the control device.

5. The method of claim 1, including detecting the movable device within a specific zone of track, and transmitting a control signal from the control device to an external device to operate the external device in response to receipt of the unsolicited identification data package.

6. The method of claim 1, in which said unsolicited identification data package is transmitted with data identifying characteristics of the movable device.

7. The method of claim 6, in which said characteristics are selected from a group consisting of type of movable device, route information pertaining to the movable device, location of the moveable device on the tacks, speed of the moveable device, load of the moveable device, and special flags usable by the control device for controlling at least one of the movable device and an external device in communication with the control device.

8. The method of claim 7, in which said external device is a sound generating device.

9. The method of claim 1, in which at least a portion of said identification data package is included in all communication packets received by said movable device.

10. The method of claim 9, in which said at least a portion of said identification data package is included in preamble bits of said communication packets.

11. The method of claim 1, including encoding said unsolicited data identification package, wherein said data identification package includes the same number of bits having a value of 1 as the number of bits have a value of 0.

12. The method of claim 1, in which a communication transmitted by the movable device over the communication network is in response to a communication from the control device includes said unsolicited identification data package.

13. The method of claim 1, in which said unsolicited identification package is included in a communication broadcast by said moveable device over the communication network.

14. A control system for controlling a model railroad, said model railroad including at least one movable device disposed on tracks for movement along said tracks, at least one control device, and a communication network providing bi-directional bit communication between the at least one movable device and the at least one control device, said method comprising:

means for transmitting an unsolicited identification data package from the movable device over said communication network, said identification data package including data identifying the movable device.

15. The system of claim 14, including means for selectively transmitting a command data package from the control device to the movable device in response to said identification data package over said communication network, said command data package including data recognizable by the movable device as a command to control the behavior of the movable device.

16. The system of claim 15, including means for transmitting an acknowledgement data package from the movable device to the control device over said communication network, said acknowledgement data package including data recognizable by the control device as an acknowledgement of receipt of said command data package.

17. The system of claim 16, in which said command data package includes a command to provide information to the control device, and said acknowledgement data package includes the information requested by the control device.

18. The system of claim 14, including means for detecting the movable device within a specific zone of track, and transmitting a control signal from the control device to an external device to operate the external device in response to receipt of the unsolicited identification data package.

19. The system of claim 14, in which said unsolicited identification data package is transmitted with data identifying characteristics of the movable device.

20. The system of claim 19, in which said characteristics are selected from a group consisting of type of movable device, route information pertaining to the movable device, location of the moveable device on the tacks, speed of the moveable device, load of the moveable device, and special flags usable by the control device for controlling at least one of the movable device and an external device in communication with the control device.

21. The system of claim 19, in which said external device is a sound generating device.

22. The system of claim 14, in which said unsolicited identification data package is included in preamble bits of all communication packets transmitted by said movable device.

23. The system of claim 14, including means for encoding said unsolicited data identification package, wherein said data identification package includes the same number of bits having a value of 1 as the number of bits have a value of 0.

24. The system of claim 14, in which a communication transmitted by the movable device over the communication network is in response to a communication from the control device includes said unsolicited identification data package.

25. The system of claim 14, in which said unsolicited identification package is included in a communication broadcast by said moveable device over the communication network.

26. A method for controlling a model railroad, said model railroad including at least one movable device disposed on tracks for movement along said tracks, at least one control device, and a communication network providing bi-directional bit communication between the at least one movable device and the at least one control device, said method comprising:

transmitting an encoded identification data package in all communication packets transmitted by the movable device.

27. The method as in claim 26, in which said encoded identification data package includes the same number of bits having a value of 1 as the number of bits have a value of 0.

28. The method as in claim 26, in which said encoded identification package is transmitted in preamble bits of said communication packets.

29. A method for controlling a model railroad, said model railroad including at least one movable device disposed on tracks for movement along said tracks, at least one control device, and a communication network providing bi-directional bit communication between the at least one movable device and the at least one control device, said method comprising:

acknowledging a data packet transmitted by the control device to the moveable device by transmitting a data packet having first and second data byte start bits from the moveable device to the control device, wherein the first and second data byte start bits are used for the purpose of acknowledging receipt of the data packet transmitted by the control device.

* * * * *